US007032773B2

(12) United States Patent
Dees et al.

(10) Patent No.: US 7,032,773 B2
(45) Date of Patent: Apr. 25, 2006

(54) FOOD CONTAINER WITH INTERCHANGEABLE LID—BASE SEAL PROVIDED WITH UNDERCUT SEALING PROFILE AND ASYMMETRIC INTERLOCKABLE STACKING RIDGES

(75) Inventors: Jerome G. Dees, Appleton, WI (US); Rebecca E. Whitmore, Chilton, WI (US); Gerald J. Van Handel, Neenah, WI (US); Mark B. Littlejohn, Appleton, WI (US); Luther A. Gross, Churubusco, IN (US); Mark A. Cruz, Fort Wayne, IN (US)

(73) Assignee: Fort James Corporation, Atlanta, GA (US)

( * ) Notice: Subject to any disclaimer, the term of this patent is extended or adjusted under 35 U.S.C. 154(b) by 109 days.

(21) Appl. No.: 10/756,657

(22) Filed: Jan. 13, 2004

(65) Prior Publication Data

US 2004/0144781 A1 Jul. 29, 2004

Related U.S. Application Data

(63) Continuation-in-part of application No. 10/151,632, filed on May 20, 2002, now Pat. No. 6,923,338.

(60) Provisional application No. 60/293,796, filed on May 25, 2001, provisional application No. 60/441,960, filed on Jan. 23, 2003.

(51) Int. Cl.
*B65D 41/18* (2006.01)

(52) U.S. Cl. ..... 220/793; 220/4.24

(58) Field of Classification Search ..... 220/793, 220/4.24, 4.25, 4.26, 780–794, 797, 805, 220/4.21, 623, 605

See application file for complete search history.

(56) References Cited

U.S. PATENT DOCUMENTS

| | | | | |
|---|---|---|---|---|
| 2,999,611 A | | 9/1961 | Paulson | 220/4 |
| 3,565,146 A | | 2/1971 | Arnolds | 150/5 |
| 3,620,403 A | | 11/1971 | Rump | 220/4 E |
| 3,664,538 A | | 5/1972 | Fioretti | 220/4 E |
| 3,704,779 A | | 12/1972 | Nigg | 206/47 R |
| 3,933,295 A | | 1/1976 | Congleton | 229/2.5 |
| 4,195,746 A | * | 4/1980 | Cottrell | 220/4.24 |
| 4,294,371 A | | 10/1981 | Davis | 220/4 E |
| 4,360,118 A | | 11/1982 | Stern | 220/4 E |
| 4,838,444 A | | 6/1989 | Bitel | 220/4 E |
| 4,974,738 A | | 12/1990 | Kidd et al. | 220/4 E |
| 5,036,980 A | | 8/1991 | Vigue et al. | 206/515 |

(Continued)

*Primary Examiner*—Lien M. Ngo
(74) *Attorney, Agent, or Firm*—Georgia-Pacific Corporation; Jacqueline M. Hutter

(57) ABSTRACT

There is provided a container having both male and female sealing regions disposed about its periphery in a pattern making it possible to seal a container with another container having substantially identical sealing regions. The male sealing regions used in the practice of the present invention may take the form of a U-shaped ridge which is undercut along at least one leg of the U in a radial direction. Typically, a container will be thermoformed from lightweight thermoplastic material giving the U-shaped ridge considerable flexibility. The female sealing regions used in the practice of the invention may take the form of an undercut channel adapted to receive and match the undercut U-shaped ridges found in the male portion of the container wherein the walls and base of the channel are sufficiently flexible that the undercut portions of the U-shaped ridge are urged into engagement with the undercut portions of the channel. Transition regions between the channels and ridges have arculate undercut profiles to further seal the container. The containers are further provided with asymmetric stacking features and inclined separator tabs.

54 Claims, 9 Drawing Sheets

U.S. PATENT DOCUMENTS 5,046,659 A 9/1991 Warburton ..... 229/2.5
5,356,023 A * 10/1994 Krupa ..... 220/4.24
5,377,860 A 1/1995 Littlejohn et al. ..... 220/306
5,390,807 A * 2/1995 Galaburda ..... 220/4.24
5,419,451 A * 5/1995 Bitel, Jr. ..... 220/575
5,862,930 A * 1/1999 Orkisz ..... 220/4.23

* cited by examiner

FOOD CONTAINER WITH INTERCHANGEABLE LID—BASE SEAL PROVIDED WITH UNDERCUT SEALING PROFILE AND ASYMMETRIC INTERLOCKABLE STACKING RIDGES

CROSS-REFERENCE TO RELATED APPLICATION

This application is a continuation-in-part of U.S. patent application Ser. No. 10/151,632 filed May 20, 2002, now U.S. Pat. No. 6,923,338, entitled "Food Container with Interchangeable Lid—Base Seal Design", which was based upon U.S. Provisional Application No. 60/293,796, of the same title, filed on May 25, 2001. This application is also based upon U.S. Provisional Application No. 60/441,960 filed Jan. 23, 2003, entitled "Food Container With Interchangeable Lid—Base Seal Provided with Radially and Circumferentially Undercut Sealing Profile, Asymmetric Interlocking Stacking Ridges and Improved Separator Tab". The priorities of the foregoing applications are hereby claimed.

TECHNICAL FIELD

The present invention relates generally to containers, and in particular to a container formed of a thermoplastic material having an interlockable rim structure defined about the periphery thereof. The interlockable rim structure has at least one radially undercut male ridge section and at least one radially undercut female groove section defined therein; these respective sections are configured such that male and female sections on a food container having a substantially identical interlockable rim structure will seal in interpenetrating engagement. A pair of vertically extending transition sections have undercut arculate profiles in order to further seal the container. Further provided are novel stacking features and separator tabs.

BACKGROUND ART

Conventional food service containers for serving or storing food are well known. The prior art is replete with such containers; one preferred container being disclosed in U.S. Pat. No. 5,377,860 to Littlejohn et al. In the '860 patent there is disclosed a food container which is a combination of a base portion and a lid portion made of a resilient polymeric material. The base is a unitary component including an upwardly projecting, peripherally extending sealing rim having inner and outer sealing areas. The lid is also a unitary component including a peripherally extending sealing channel correspondingly shaped to receive the sealing rim of the base and particularly, to engage the rim at the inner and outer sealing areas. Because both the base and lid are made from a resilient material, the inner and outer sealing materials are shaped to provide a self-reinforcing seal configuration wherein the initial engagement of either the inner or the outer seals urges the other seal into engagement. This feature can accommodate a good degree of tolerance of variations in the dimensions of the lid and the base which are occasioned by variances in the caliper of the substrate.

Various designs have also been proposed for nestable food containers which are reversible to define a lower portion and an upper portion. There is disclosed, for example, in U.S. Pat. No. 5,036,980 to Vigue et al. a nestable food container which is reversible to define a dish or a cover in a composite container. A male and female locking arrangement is provided on the container together with a stabilizing system of protrusions and depressions to stabilize the locked container engagement.

In U.S. Pat. No. 4,974,738 to Kidd et al. there is shown a container provided with a tray component and an independent cover component which is adapted to assume open and closed modes with respect to the tray component. The components are interchangeable and each is provided with a recessed center portion having a base delimited by an angularly extending wall. An edge of the wall defines an open side. Each component also includes a laterally extending rim protruding outwardly from the wall edge. A predetermined first portion of the rim is provided with a first lock member and a predetermined second portion of the rim is provided with a second lock member. When the components are in the closed mode, the first lock member of the tray component is in interlockable engagement with the second lock member of the cover component and vice versa.

In U.S. Pat. No. 4,360,118 to Stern there is disclosed a self-mating pizza pie container. The container includes a pair of circular, shallow container lower and upper half sections, integrally molded of a lightweight, thermally insulating material. Formed along their peripheral sidewalls are mutually interfitting and interlockable means which are configured to be readily releasable for uncovering a contained pizza. Each half section has in its peripheral rim a diagonally opposed locating pin and locating recess for the interfitting reception of the complemental locating and pin recess of the companion half section for relative rotational locating of the two half sections.

U.S. Pat. No. 4,195,746 to Cottrel discloses a food container for the storage and transport of food; especially a hot food such as pizza. The container includes identical upper and lower portions each portion having a flat base surface, outwardly extending sidewalls and a circumferential lip thereabout. A locking portion is carried on the lip to releasably lock the upper and lower portions together. A plurality of vertical honeycombs on the interior of the base surface and a plurality of buttresses are formed in the interior sidewalls.

U.S. Pat. No. 4,294,371 to Davis discloses a food container; in particular, a sundae dish having a bottom dish and a cover that are identical. The rim structure of each part is part male and part female. Each dish is provided with a locking element. The two parts of the container are self-aligned by virtue of the rim structures so that when one is inverted on the other the locking elements are aligned for convenient locking of the container.

U.S. Pat. No. 3,704,779 to Nigg discloses a food tray made of a plastic material with integral break off cutlery. The device includes a substantially rectangular receptacle portion for containing food items and free cutlery pieces protected by a surrounding reinforced frame and arranged so they can be easily broken off by a user. Moreover, the tray maybe detachably secured to another tray to form a closed container as is noted in Column 2, line 38 and following.

In U.S. Pat. No. 3,664,538 to Fioretti there is disclosed a nestable food receptacle including a bottom and plurality of upstanding ear members on the periphery of the bottom member. First ear members alternate in position on the periphery with the second ear members. The receptacles when engaged to one another form a container having a cavity between the bottom members of the receptacles defined by the vertical dimension of the walls of the ear members.

U.S. Pat. No. 3,620,403 to Rump discloses a thin wall thermoplastic container which includes identical dish and cover portions. Each portion has a peripherally extending flange for supporting the other when one is placed on the other to form the assembled container.

SUMMARY OF THE INVENTION

The male sealing regions used in the practice of the present invention may take the form of a U-shaped ridge which is undercut along at least one leg of the U. Typically containers of the present invention will be thermoformed from lightweight thermoplastic material giving the U-shaped ridge considerable flexibility. The female sealing regions used in the practice of the present invention take the form of an undercut channel adapted to receive the undercut U-shaped ridges found in the male portion of the container wherein the walls and base of the channel are sufficiently flexible that the undercut portions of the U-shaped ridge are urged into engagement with the undercut portions of the channel while the crest of the ridge is urged into the channel. Preferably, the crest of the ridge is urged into engagement with the bottom of the channel and more preferably both a medial portion of the crest of the U-shaped ridge and a mating medial portion of the bottom of the corresponding channel take the form of substantially mating surfaces so that as the undercut portions of the channel and the undercut portions of the U-shaped ridge are urged into engagement, substantial surface-to-surface contact between the medial portions of the crest of the U-shaped ridge and the bottom of the channel will form an additional seal, although this is not required for all applications. In preferred embodiments, both legs of the U's will be undercut. Transition sections between the grooves and ridges also have undercuts spanning a direction perpendicular to the undercuts on the grooves and ridges. That is, the transition sections have "arculate" undercuts extending around the small arc or "arcule" at the ends of the respective grooves and ridges while the grooves and ridges themselves are "radially" undercut along their length so that there are radial sealing features extending around the periphery of the containers along the grooves and ridges as well as arculate sealing features at the transitions between the grooves and ridges. Throughout this specification and claims, use of the terms "radial" and "radially" should not be understood to imply that the container must be circular or that a "radial undercut" is perfectly parallel to a line from the center of the container but only that the "radial undercut" extends generally inwardly toward, or outwardly from, the center of the container.

There is thus provided in accordance with the present invention a thermoplastic container having a dome portion with a substantially planar central portion and a sidewall extending from the central portion of the dome and transitioning to a rim wherein the rim has an interlockable rim structure defined about the periphery of the container in a rim plane. The interlockable rim structure has at least one radially undercut male ridge section and at least one radially undercut female groove section defined therein, as well as a pair of arculate undercut transition sections therebetween. The radially undercut male ridge and the radially undercut female groove section are configured such that radially undercut male ridge and radially undercut female groove sections on a container having a substantially identical interlockable rim structure will seal with inter-penetrating resilient engagement about the periphery of the container. The radial undercuts on the ridges and grooves are configured to urge the grooves and ridges on containers having a substantially identical interlockable rim structure into sealing engagement; and the arculate undercut transition sections are configured such that the arculate undercut transition sections on containers having a substantially identical rim structure will urge the respective transition sections into virtually sealing engagement when the containers with like rim structures are joined to form a sealed enclosure. In a preferred embodiment, the arculate undercut transition sections have a vertically extending female undercut wall, a vertically extending male undercut wall and a ledge therebetween. So also the dome may be generally rectangular and provided with reinforced rounded corners which project radially outwardly from recessed sidewall portions therebetween. In a particularly preferred embodiment, the central portion of the dome is provided with a plurality of asymmetrically disposed arcuate stacking ridges at the corners of the central portion of the dome, the stacking ridges having generally the same curvature as the side wall at the corners and being asymmetrically offset across an axis of rotation so as to cooperate with like ridges on an inverted like container to secure a plurality of containers when stacked together. These stacking features may have a variety of configurations so long as they extend in generally orthogonal directions so as to secure the containers from sliding when they are stacked.

Most preferably, the rim structure defines at least one separator tab provided with a surface which is inclined with respect to the rim plane. Typically the angle of inclination of the inclined surface of the rim tab has an angle of inclination of from about 3 to about 40° with respect to the rim plane. More preferably that angle of inclination is from about 10 to about 30° with respect to the rim plane.

The undercut male ridge section and undercut female groove section are typically U-shaped and preferably have an undercut on both sidewalls thereof. So also the undercut male ridge section and the female undercut groove section each include a substantially planar medial portion. The undercut male ridge section and the undercut female groove section are preferably configured such that their respective substantially planar medial sections are urged into engagement with each other; and are most preferably configured such that their respective substantially planar medial sections are urged into surface to surface engagement with each other between the sidewalls of the groove and ridge sections by cooperation of the sidewalls and especially the undercuts therein.

The inventive containers may be made by any suitable method. For example, the thermoplastic containers are made by way of injection molding, injection blow molding, compression molding, injection stretch blow molding and composite injection molding. More preferably, the thermoplastic containers of the invention are formed from a sheet of thermoplastic material. The container is thus thermoformed, thermoformed by application of vacuum, or thermoformed by a combination of vacuum and pressure. In particularly preferred embodiments the containers are thermoformed by the application of vacuum and pressure.

The thermoplastic material from which the containers are made may include any suitable material. Preferably, the thermoplastic material includes a polyester, a polystyrene, a polypropylene, a polyethylene or mixtures thereof. Still yet other suitable thermoplastic materials include polyamides, polyacrylates, polysulfones, polyetherketones, polycarbonates, acrylics, polyphenylene sulfides, liquid crystal polymers, acetals, cellulosic polymers, polyetherimides, polyphenylene ethers or oxides, styrene-maleic anhydride copolymers, styrene acrylonitrile copolymers, polyvinylchlorides and mixtures thereof. If so desired, the polymeric material may be mineral filled even though, as mentioned later, the containers are illustrated herein as if translucent.

The thermoplastic sheet from which the container is made typically has a wall thickness of from about 5 to about 50 mils which also corresponds generally to the wall thickness of the container. A container wall thickness of from about 15 mils to about 25 mils is typical; however, a broader range of wall thicknesses is possible from about 5 to about 80 mils for example depending on the type of material selected. A thicker wall may be desired when using a foamed composition, for example. In one embodiment the thermoplastic container is made from a polypropylene polymer mineral filled with mica and the material is from about 40 to about 90 weight percent polypropylene and from about 10 to about 50 percent by weight mica. There may be further included in such embodiments calcium carbonate to control odor.

In another aspect of the present invention there is provided a container integrally formed of a thermoplastic material such as polypropylene having a dome with a central portion and a sidewall which transitions to an interlockable rim structure about a rim plane defined about the periphery thereof where the interlockable rim structure includes a male ridge section projecting upwardly from the rim plane extending circumferentially over at least a portion of the periphery of the container; a female groove section projecting downwardly from the rim plane extending circumferentially over at least a portion of the periphery of the container and a pair of transition sections extending between the male ridge section and the female groove section. The interlockable rim structure is configured to seal with a substantially identical rim structure rotated 180° about an axis of rotation such that when the male ridge sections are disposed in sealing engagement with the corresponding female groove sections the ridges and grooves are urged into surface to surface engagement and the transition sections are urged into virtually sealing engagement with the corresponding transition sections of the substantially identical rim structure.

In still yet other aspects of the invention, the transition sections between the ridges and grooves are shaped to reduce the local draw ratio associated with the sealing rim features of the inventive containers. There is provided a thermoformed container having a dome portion with a substantially planar central portion with a sidewall extending from the central portion of the dome and transitioning to a rim wherein the rim has an interlockable rim structure defined about the periphery of the container in a rim plane, the interlockable rim structure having at least one radially undercut male ridge section and at least one radially undercut female groove section defined therein, as well as a pair of transition sections therebetween. The radially undercut male ridge and radially undercut female groove sections are drawn generally at a sealing rim draw ratio and the transition sections are drawn at a transition draw ratio that is less than the sealing rim draw ratio. Generally, the transition draw ratio is less than about 90% of the sealing rim draw ratio and typically the transition draw ratio is less than about 80% of the sealing rim draw ratio. In some preferred embodiments, the transition draw ratio is less than about 70% of the sealing rim draw ratio.

These and other features of the present invention will be more readily understood by reference to the following description and appended drawings.

BRIEF DESCRIPTION OF DRAWINGS

The invention is described in detail below with reference to the various figures where like numerals designate similar parts and wherein.

DETAILED DESCRIPTION

Figure 1:
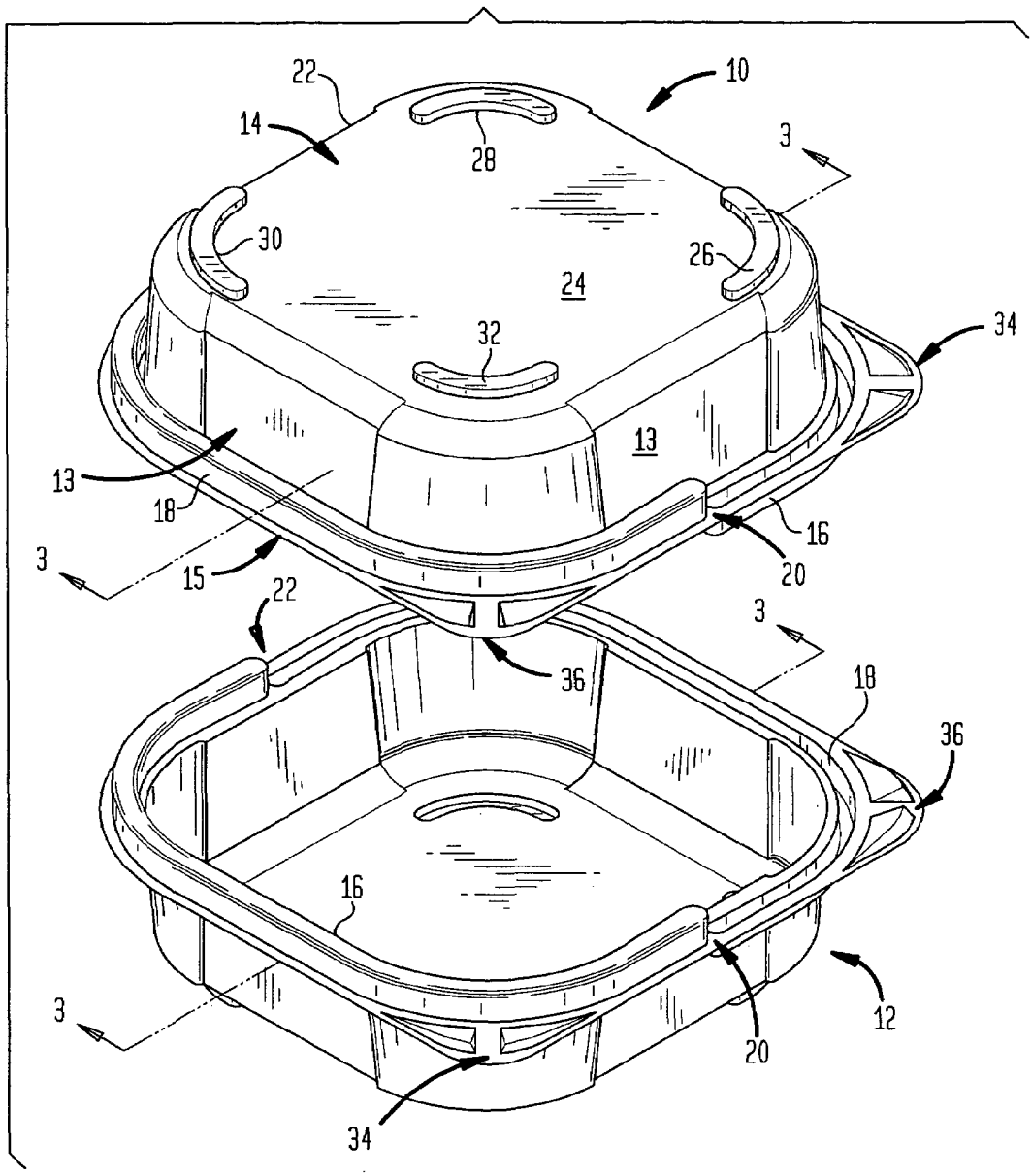
FIG. 1 is an exploded view of two containers of the present invention which may be joined together in sealing engagement.
Figure 2:
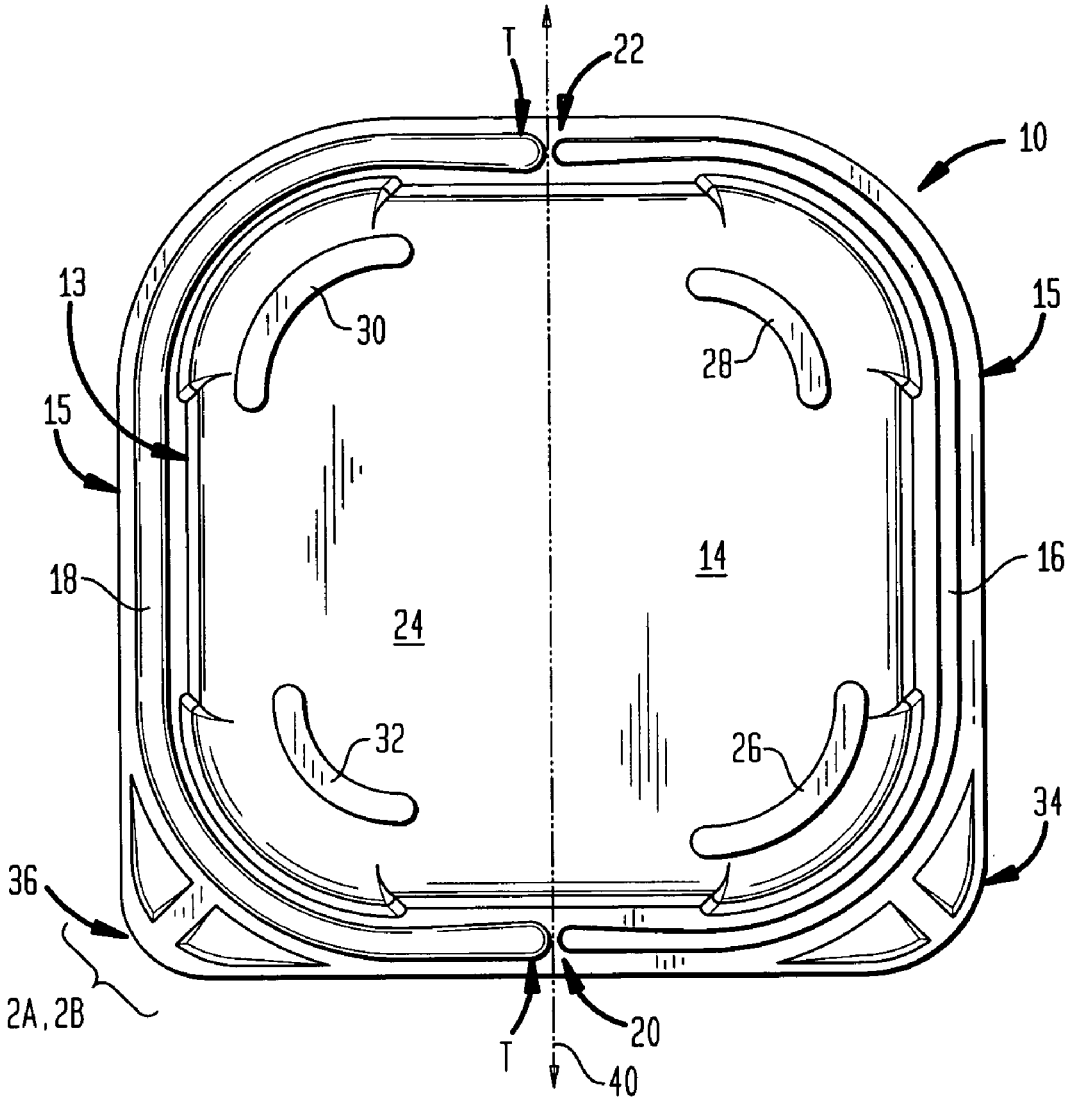
FIG. 2 is a top view of a container of FIG. 1.

Referring generally to FIGS. 1 and 2, there are shown various containers of the present invention. These containers may be made from polystyrene, polyethylene or polypropylene sheet having a thickness, for example, of from about 5 or 10 to about 50 thousandths of an inch (mils) or any other suitable thermoplastic material as noted herein. Suitable materials include polystyrenes such as impact modified polystyrene or oriented polystyrene or polyolefins such as polyethylene or polypropylene. Filled polypropylenes, particularly mineral-filled including mica-filled polypropylenes such as are disclosed in U.S. Pat. No. 6,211,501 to McCarthy et al. (incorporated herein by reference) are likewise suitable. One particularly preferred type of thermoplastic sheet is mica-filled polypropylene sheet including from about 40 to about 90% by weight polypropylene and from about 10 to about 50% by weight mica. Calcium carbonate is optionally included in the polypropylene mica material. In some instances it may be desirable to add one or more adjuvants to the polymer such as impact modifiers, UV stabilizers, antioxidants or thermal stabilizers as are known in the art in addition to mineral fillers. Still other suitable flexible and resilient materials include polyesters, polyamides, polyacrylates, polysulfones, polyetherketones, polycarbonates, acrylics, polyphenylene sulfides, liquid crystal polymers, acetals, cellulosics, polyetherimides, polyphenylene ethers/oxides, styrene maleic anhydride copolymers, styrene acrylonitrile copolymers, polyvinylchlorides, and engineered resin derivatives thereof. These materials may be filled or unfilled, solid (continuous) or foamed. When made from a foamed polymeric material such as, for example, polystyrene foam or polypropylene foam, the sheet thickness may be slightly more than when a solid polymeric material is employed. A foamed wall thickness of from about 5 or 10 up to about 80 mils, for example, may be employed.

The containers of the invention may be made by any suitable technique, that is, techniques employed for forming plastics. The products may thus be made from thermoplastic sheet thermoformed by the application of vacuum or thermoformed by a combination of vacuum and pressure into the products of the invention. Alternatively, the inventive containers may be made from a plastic material by injection molding, injection blow molding, compression molding, injection stretch blow molding, composite injection molding and so forth. Thermoforming from plastic sheet with application of vacuum and pressure is particularly preferred.

Generally speaking, thermoforming is the pressing and/or stretching of heated deformable material into final shape. In the simplest form, thermoforming is the draping of a softened sheet over a shaped mold. In the more advanced form, thermoforming is the automatic high speed positioning of a heated sheet having an accurately controlled temperature into a pneumatically actuated forming station whereby the article's shape is defined by the mold, followed by trimming and regrind collection as is well known in the art. Still other alternative arrangements include the use of drape, vacuum, pressure, free blowing, matched die, billow drape, vacuum snap-back, billow vacuum, plug assist vacuum, reverse draw with plug assist, pressure bubble immersion, trapped sheet, slip, diaphragm, twin-sheet cut sheet, twin-sheet rollfed forming any suitable combinations of the above. Details are provided in J. L. Throne's book, *Thermoforming*, published in 1987 by Coulthard. Pages 21 through 29 of that book are incorporated herein by reference. Suitable alternate arrangements also include a pillow forming technique which creates a positive air pressure between two heat softened sheets to inflate them against a clamped male/female mold system to produce a hollow product. Metal molds are etched with patterns ranging from fine to coarse in order to simulate a natural or grain like texturized look. Suitable formed articles are trimmed in line with a cutting die and regrind is optionally reused since the material is thermoplastic in nature. Other arrangements for productivity enhancements include the simultaneous forming of multiple articles with multiple dies in order to maximize throughput and minimize scrap.

The female sealing regions used in the practice of the present invention take the form of an undercut channel adapted to receive the undercut U-shaped ridges found in the male portion of a container wherein the walls and base of the channel are sufficiently flexible that the undercut portions of the U-shaped ridge are urged into engagement with the undercut portions of the channel.

As used herein, the terminology "male" generally refers to a part projecting away from the planar portion of the container (i.e. the bottom or dome of a container) whereas the terminology "female" generally refers to a part projecting toward the planar container bottom portion. The term "dome" refers generally to a bowl-type structure which when inverted and mated with another container forms a lid. The dome or bowl is typically somewhat rounded and has a plurality of generally planar panels. Typically, the maximum width of the male ridge exceeds the minimum width of the female grooves by about 10 to 20 mils. Foamed products may have larger size differentials up to 80 mils. It will be appreciated from the following discussion that the male sealing regions used in the practice of the present invention may take the form of a U-shaped ridges which are undercut along at least one leg of the U. We term these undercuts "radial" undercuts since they extend in a direction which is roughly parallel to a radial line from the center of the container. Typically containers of the present invention will be thermoformed from lightweight thermoplastic material giving the U-shaped ridge considerable flexibility. Preferably, the crest of the ridge is urged into engagement with the bottom of the channel, and more preferably, both a medial portion of the crest of the U-shaped ridge and a mating medial portion at the bottom of the corresponding channel form mating surfaces so that as the undercut portions of the channel and the undercut portions of the U-shaped ridge are urged into engagement, substantial surface to surface contact between the medial portions of the crest of the U-shaped ridge and the bottom of the channel will form an additional seal.

Referring to the Figures, there is shown in FIG. 1 an exploded view of two mating containers showing a first container 10 and a second container 12. Throughout this description of the Figures, it should be understood that in the illustrated embodiments the materials are translucent, thus many lines are illustrated as solid lines which would be hidden lines in opaque embodiments. Each container has a dome portion 14 which includes a sidewall 13 which transitions to a rim 15. The rim of each container has a male ridge section 16 as well as a female groove section 18 which are separated on each container by transition sections 20 and 22. The dome has a flat portion 24 as well as a plurality of stacking ridges 26, 28, 30, and 32.

The rim is also provided with two separator tabs 34, 36, at two adjacent corners of the containers.

Figure 3:
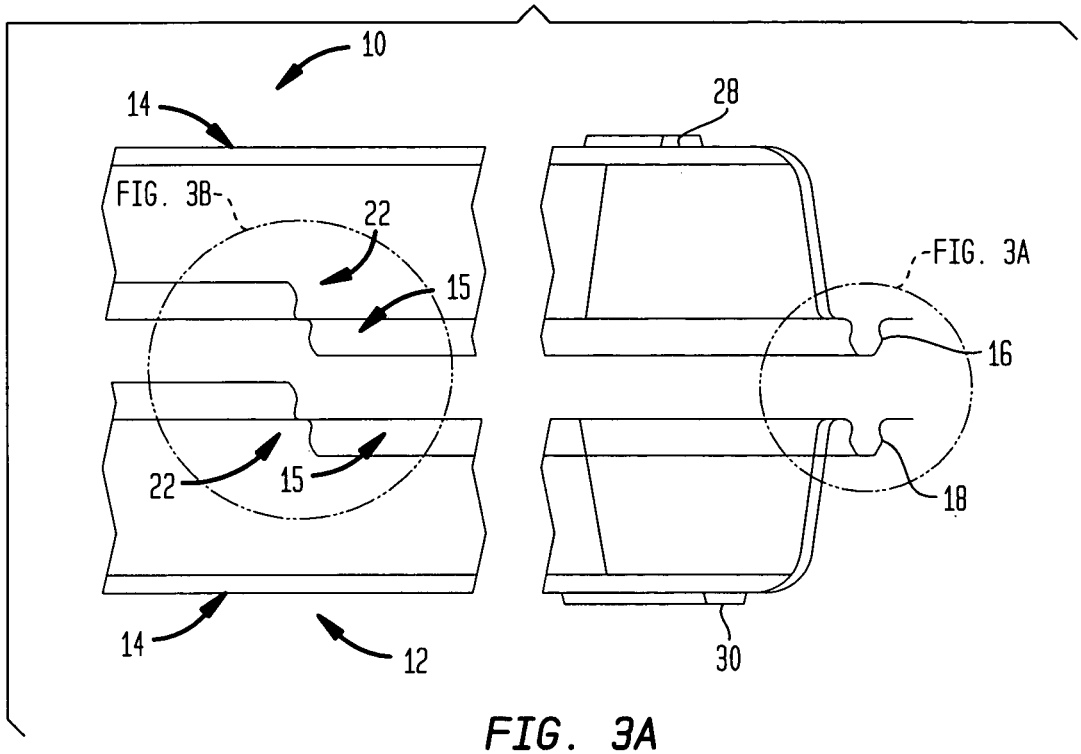
FIG. 3 is a partial view in section and elevation of the containers taken along line 3—3 of FIG. 1.

Referring now to FIG. 2, the interlockable rim structures of the containers are, generally speaking, symmetrical about an axis of rotation 40 such that, when a container is rotated or inverted, it will mate with a like container to form a sealed enclosure. That is to say the inventive containers can function as both the lid and the base of a container as is shown in FIGS. 1, 3, and 4. It should be noted that the tabs 34, 36 project outwardly from the sealing grooves and ridges further than any other areas of the rim. So also, generally speaking the interlockable rim structure including the male ridge sections, the female groove sections as well as the transition sections are generally formed about a rim plane 38 which is generally at the base of the ridges and the top of the female groove sections as is shown schematically in FIG. 3B.

Figure 2A:
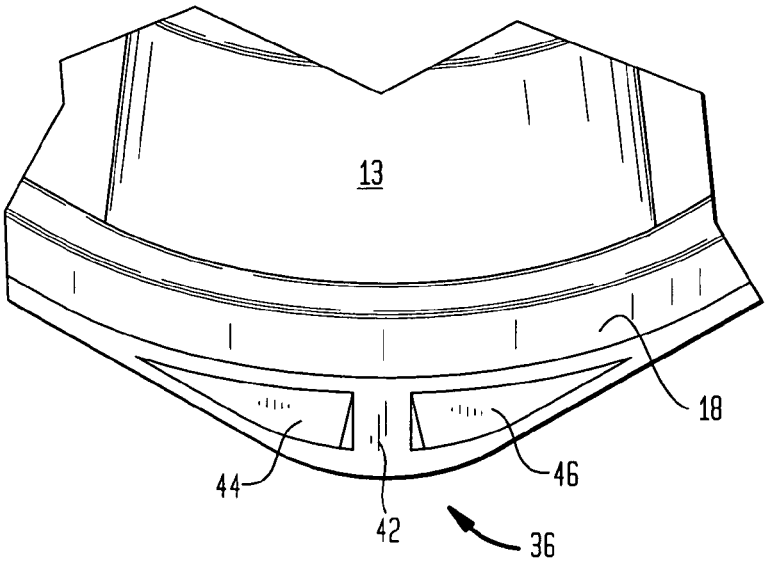
FIG. 2A is a view in perspective of a separator tab of the container of FIG. 2.
Figure 2B:
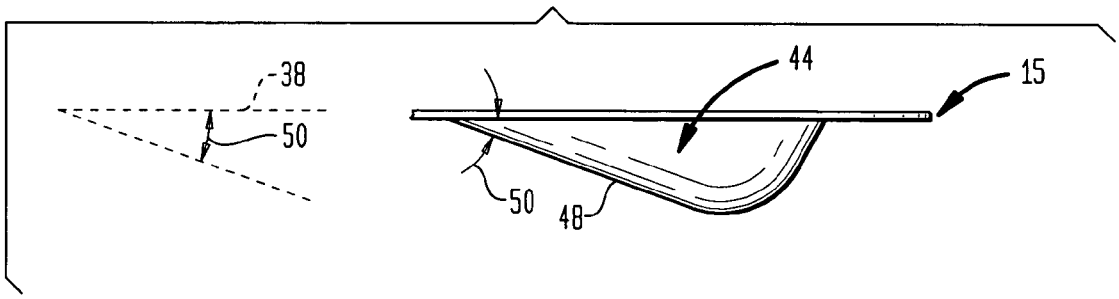
FIG. 2B is an enlarged schematic side view of the inclined separator tab of FIG. 2A.

Referring specifically to FIG. 2A there is shown in enlarged detail in a top perspective view of tab 36. Tab 36 includes a central raised spoke 42 as well as inclined cavities 44 and 46. The geometry of the cavities is shown schematically in FIG. 2B where it is seen that inclined cavity 44 has an inclined surface 48 which defines an angle of inclination 50 with respect to rim plane 38. Angle 50 is generally from about 3 to 40 and preferably from about 10 to about 30°. The inclined structure of the separator tabs urges them apart such that a sealed container may be readily separated as will be appreciated from the discussion which follows. Most preferably, the tabs are of different lengths as is shown in the various diagrams.

Referring to FIG. 3 there is shown in partial section in elevation an exploded view of inventive containers 10 and 12 in position for forming a sealed container but still separated from each other. It can be seen that the various rim sections such as section 16, 18 and as well as transitions sections such as section 22 will cooperate when inverted to form complimentary structures which will seal a pair of containers to one another. More specifically there is shown schematically in FIG. 3A an enlarged detail showing male ridge section 16 of container 10 and female groove section 18 of container 12. Male ridge section 16 is generally U-shaped as shown in the diagram and includes a first sidewall 52 as well as a second sidewall 54 and a generally planar medial portion at the top of the ridge indicated at 56. The sidewalls are undercut a distance 58 as shown in the diagram. Likewise, female groove section 18 has a first side wall 60 and a second sidewall 62 as well as a generally planar medial portion 64. The sidewalls are undercut a distance 66 such that they will cooperate with the male sealing portions on a like container when two are joined together to form a generally liquid proof seal. Most preferably, the medial portions are urged into surface to surface contact to further seal the container.

Figure 3A:
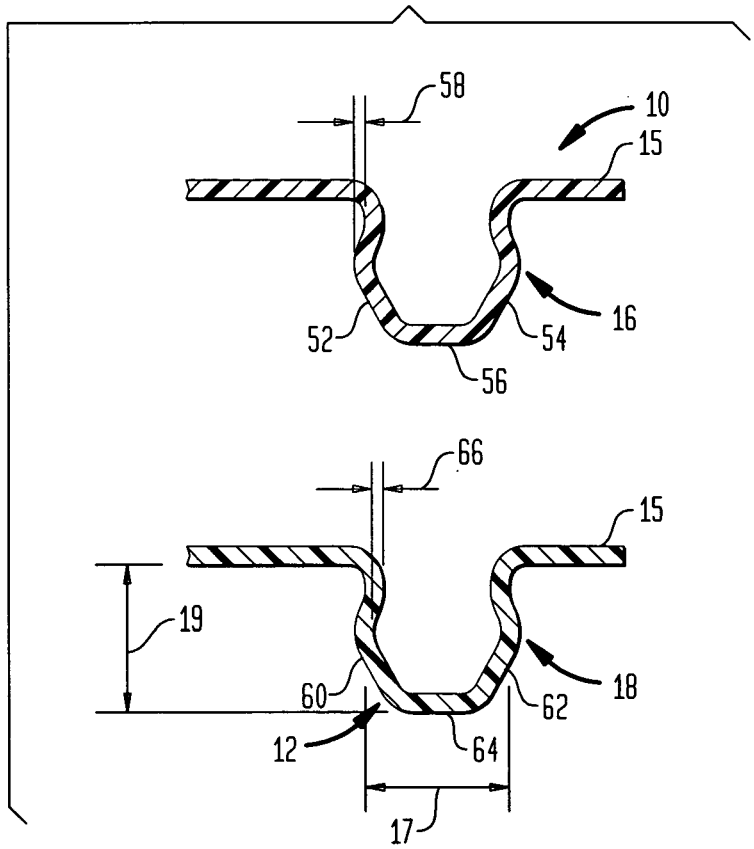
FIG. 3A is an enlarged schematic detail showing the corresponding male and female sections of the sealing rim of the containers showing in FIG. 3.
Figure 3B:
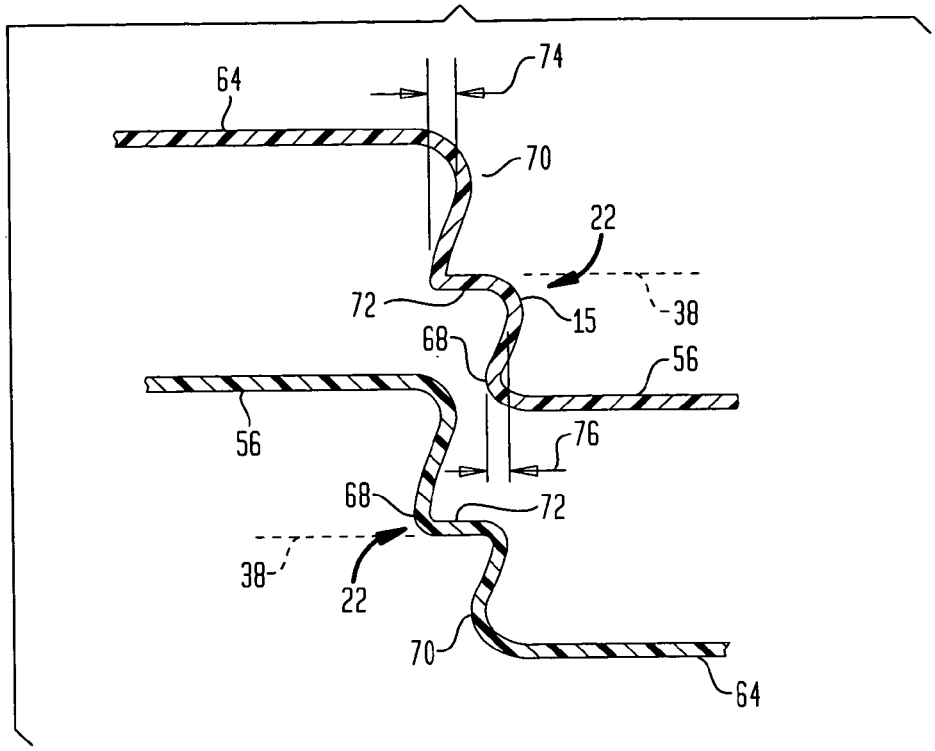
FIG. 3B is an enlarged schematic detail showing the transition sections of the containers of FIG. 3.
Figure 4:
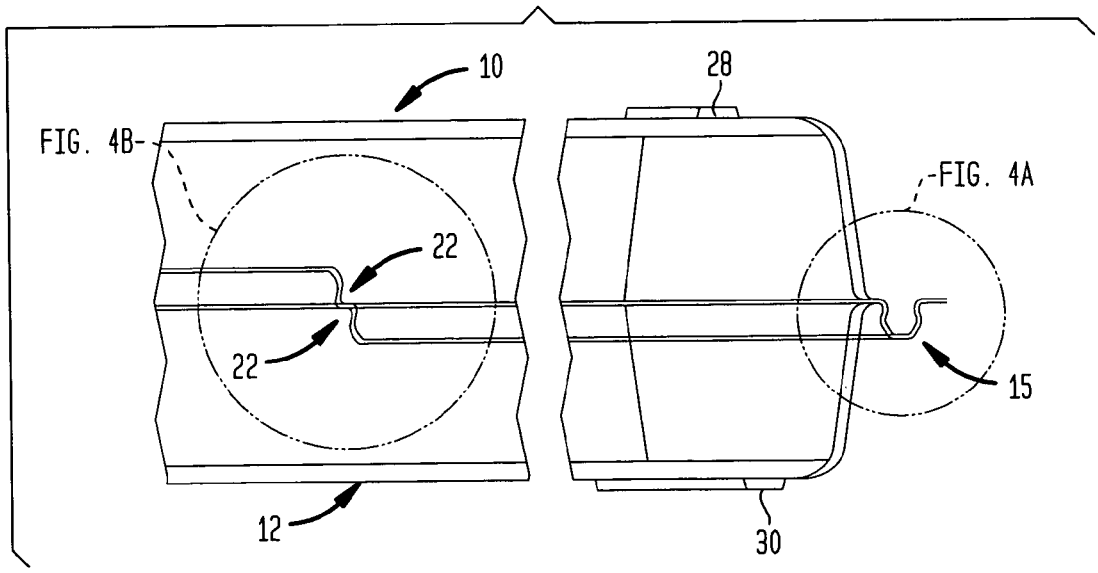
FIG. 4 is a partial view in section and elevation of the containers of FIG. 1 corresponding to FIG. 3 wherein the containers have been joined in sealing engagement to one another.

There is shown in FIG. 3B an enlarged schematic view illustrating schematically the geometry of transition sections 22 as they are placed adjacent each other preparatory to engagement as is shown in the diagram. Each transition section 22 includes a generally vertical or vertically extending male arculate undercut wall 68 as well as a generally vertical or vertically extending female arculate undercut wall 70 with a transition ledge 72 therebetween, the respective male and female vertical extending walls are undercut a distance 76 and 74 respectively in order to urge the various transition portions into engagement with a like transition portion on an inverted like container as will be appreciated from FIG. 4 and following.

There is shown in elevation and partial section generally along the sealing portions of the container a schematic profile of containers 10 and 12 joined together in FIG. 4. Container 12 is identical to container 10 and has been rotated 180° about its axis of rotation 40 (inverted) so that it will mate with container 10. Note that the various parts are configured to cooperate to form a substantially liquid proof seal as will be appreciated from FIGS. 4A and 4B which are details of the cooperation of transition sections 22 and the male and female sealing portions of the two containers; it being understood that the seals formed at the transition regions are not quite as effective as those formed in the groove and ridge regions and thus are described as being in "virtually sealing engagement" in these areas in particular when containers are joined together.

Figure 4A:
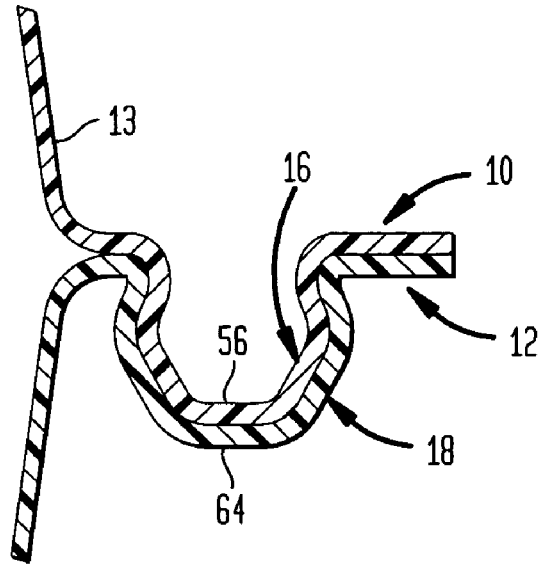
FIG. 4A is an enlarged schematic detail showing a U-shaped ridge and groove sections of the containers of FIG. 4.

In FIG. 4A it is seen that the male ridged section 16 is urged into surface to surface contact with female groove section 18, that is to say male ridge section 16 of container 10 is urged downwardly and into contact with female groove section 18 of container 12. The medial portions of the female groove section and male ridge section are urged into surface to surface contact between the sidewalls by virtue of their configuration as is seen particularly in FIG. 4A when the two containers are snapped together such that their respective undercuts cooperate to hold them together.

Figure 4B:
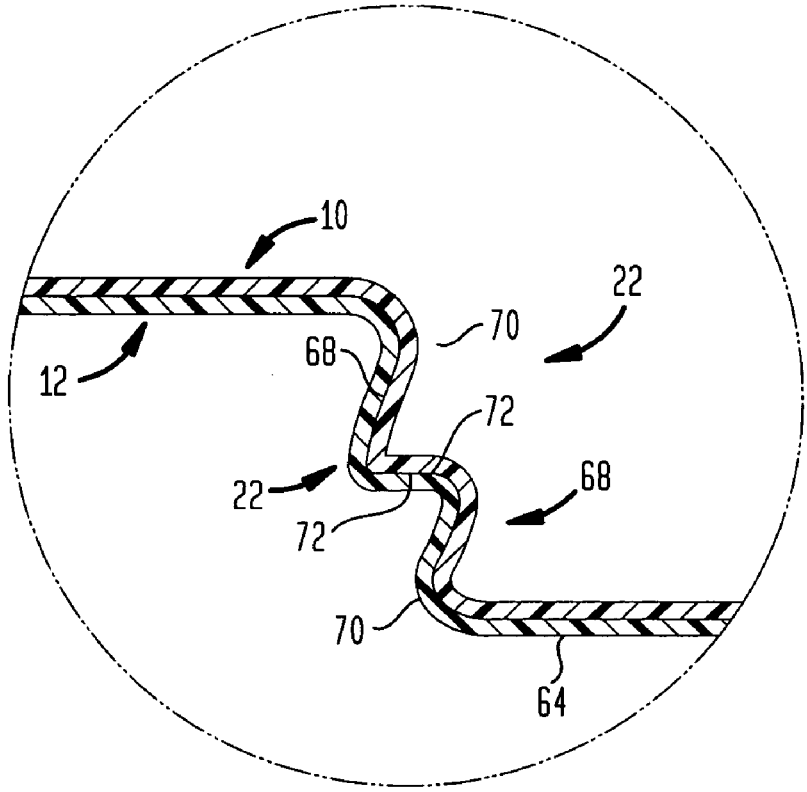
FIG. 4B is an enlarged schematic detail showing the transition sections of the containers of FIG. 4.

Likewise, the transition sections 20 and 22 of the various containers are urged into surface to surface contact particularly at opposed portions on either side of the transition ledge between the female undercut vertically extending walls and male undercut vertically extending walls as is shown in FIG. 4B. Thus there is provided in accordance with the invention a container with both radially undercut grooves and ridges and arculate undercut transition sections which urge the sealing surfaces into contact around the entire periphery of the container. That is to say, the grooves are undercut in a direction extending generally inwardly or outwardly from center while the transition sections are undercut around the arcules at the end of the respective grooves and ridges. Thus the containers will form a substantially continuous seal around the periphery of each other when placed into engagement with one another to form an enclosure. It being understood that the seal, while highly effective, especially when viewed in light of the low cost nature of the articles, is of course less than perfect, particularly at the transition regions where the seal formed might allow a few drops of moisture to penetrate when a pair of containers partially filled with water is shaken with the transition region lowermost; but compression, effort and/or agitation is required to remove more than a few drops of liquid from the joined containers.

The inventive containers are in preferred embodiments thermoformed containers. As can be seen from the various diagrams, the draw ratio of the dome portion of the containers is typically fairly low, much less than 1 in most cases; however the draw ratio of grooves 18 and ridges 16 is much higher. In general, the draw ratio of a thermoformed article or a portion thereof is the ratio of the depth of an opening divided by its width. As used herein, the terminology is adapted to the configuration of grooves 18, ridges 16 and transition sections 20, 22 as follows: (a) the "sealing rim draw ratio" is the depth 19 of the groove divided by the width 17 of the groove as shown in FIG. 3A taken as an average around the sealing rim of the container; and (b) the "transition draw ratio" is the sealing rim draw ratio in the vicinity of transitions 20, 22, at T shown in FIG. 2, immediately adjacent the curved profile of the transition where the width of the groove is at a local maximum near the transition. The grooves are widened at the transitions in the embodiments shown to reduce the draw ratio at the transition and avoid too much thinning of the container material in these regions. While some degree of thinning may enhance the configuration and performance of the undercuts, excess thinning can lead to product failure and is to be avoided in corner areas of the thermoformed article such as the transition areas. So also, note the arculate profile of the sealing surfaces of the transition sections. The problem is less severe when a male thermoforming mold is used since the seal surfaces are in contact with the mold. They are convex away from the ridge and concave toward the groove as shown. Sharp corners are thus avoided.

Figure 5:
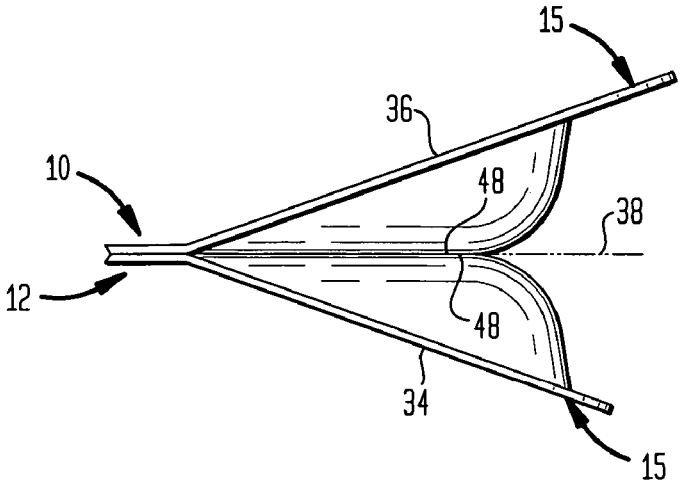
FIG. 5 is an enlarged schematic detail showing the cooperation of the inclined separator tabs of the containers of FIGS. 1 and 4 when the containers are joined together.

FIG. 5 is a schematic view of the geometry and results achieved by way of the inventive separator tabs such as tabs 34 and 36 when two of the inventive containers are joined together as is shown schematically in FIG. 4. Because it has an inclined surface 48, the tab will force the rim sections 15 to assume an angle as is shown in FIG. 5 such that they are readily separated from one another despite the fact that the containers are tightly joined together. It should also be appreciated that by virtue of the unique geometry of the stacking ridges, the stacking ridges on two like containers will cooperate to provide stability to a stack of joined containers as is shown schematically in FIG. 6.

Figure 6:
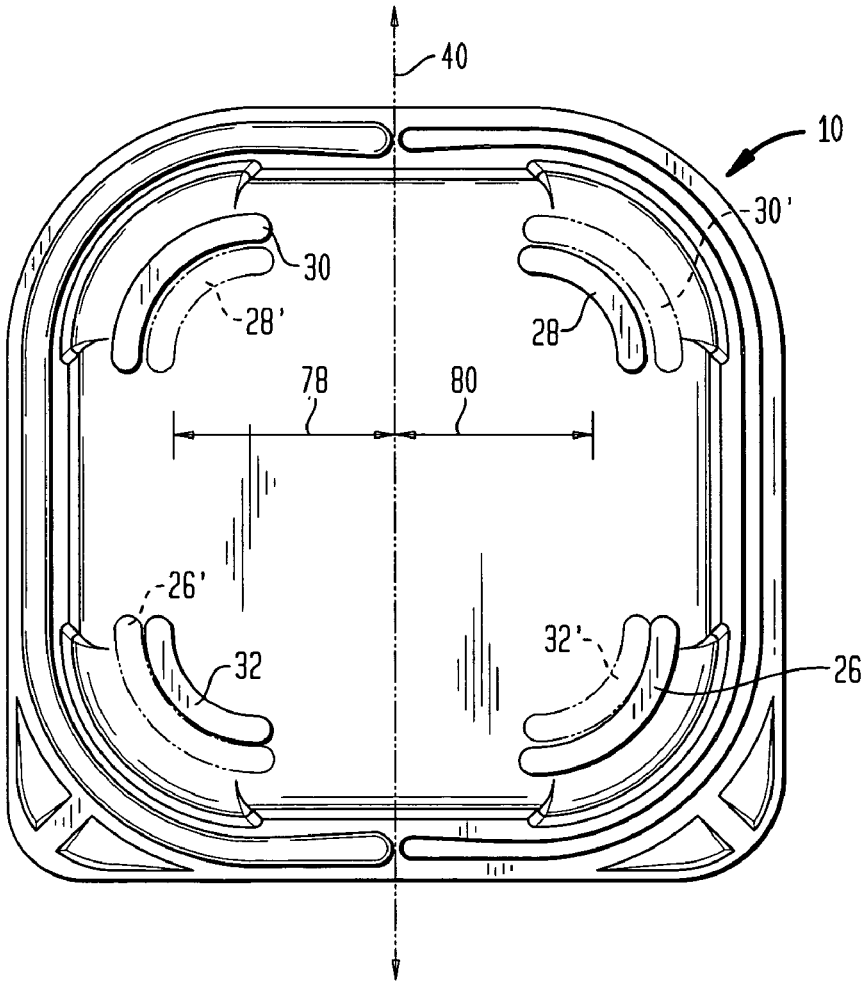
FIG. 6 is a schematic view showing the interlockable geometry of the asymmetric stacking ridges of the inventive containers.

In FIG. 6 there is shown the top of container 10 with the various stacking ridges 26, 28, 30 and 32 shown in solid lines. It will be appreciated that these stacking features are asymmetric about axis of rotation 40 in several respects. It should be appreciated from the diagram that opposed pairs of stacking ridges are at different distances 78 and 80 from axis of rotation 40. That is, the center of arcuate ridge 28 is substantially closer to axis 40 than the center of ridge 30. So also, the center of ridge 32 is closer to the axis of rotation than is the center of ridge 26. Thus, when an identical container is inverted or rotated 180° about the axis of rotation the complementary position of the various ridges is shown by the dotted lines indicating ridges 26', 32', 30' and 28' in the diagram such that the stacking ridges are interlockable and prevent stacked containers from sliding in any direction. Such geometry could of course be realized by providing non-arcuate stacking ridges with the required asymmetric configuration. Generally speaking this configuration requires that when the stacking ridges are rotated 180° they will interlock with complementary ridges on a like container so that the bottom of one container will stack in interlockable relationship with the lid of another container as will be appreciated from FIG. 6.

While the present invention has been described in connection with a preferred embodiment, variations and modifications of such embodiments within the spirit and scope of the present invention, set forth in the appended claims, will be readily apparent to those of skill in the art.

Figure 7:
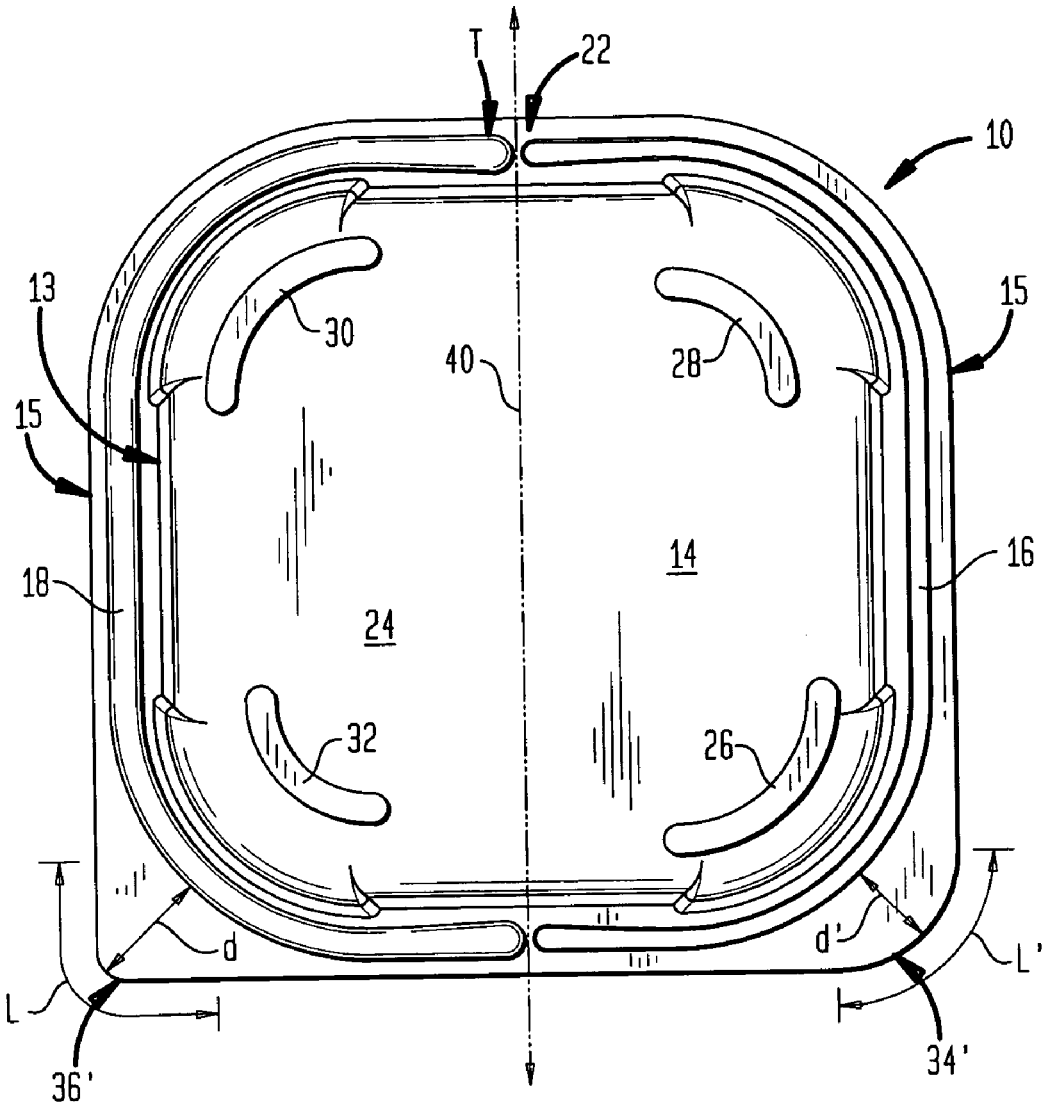
FIG. 7 is a top view of another container of the present invention.
Figure 8:
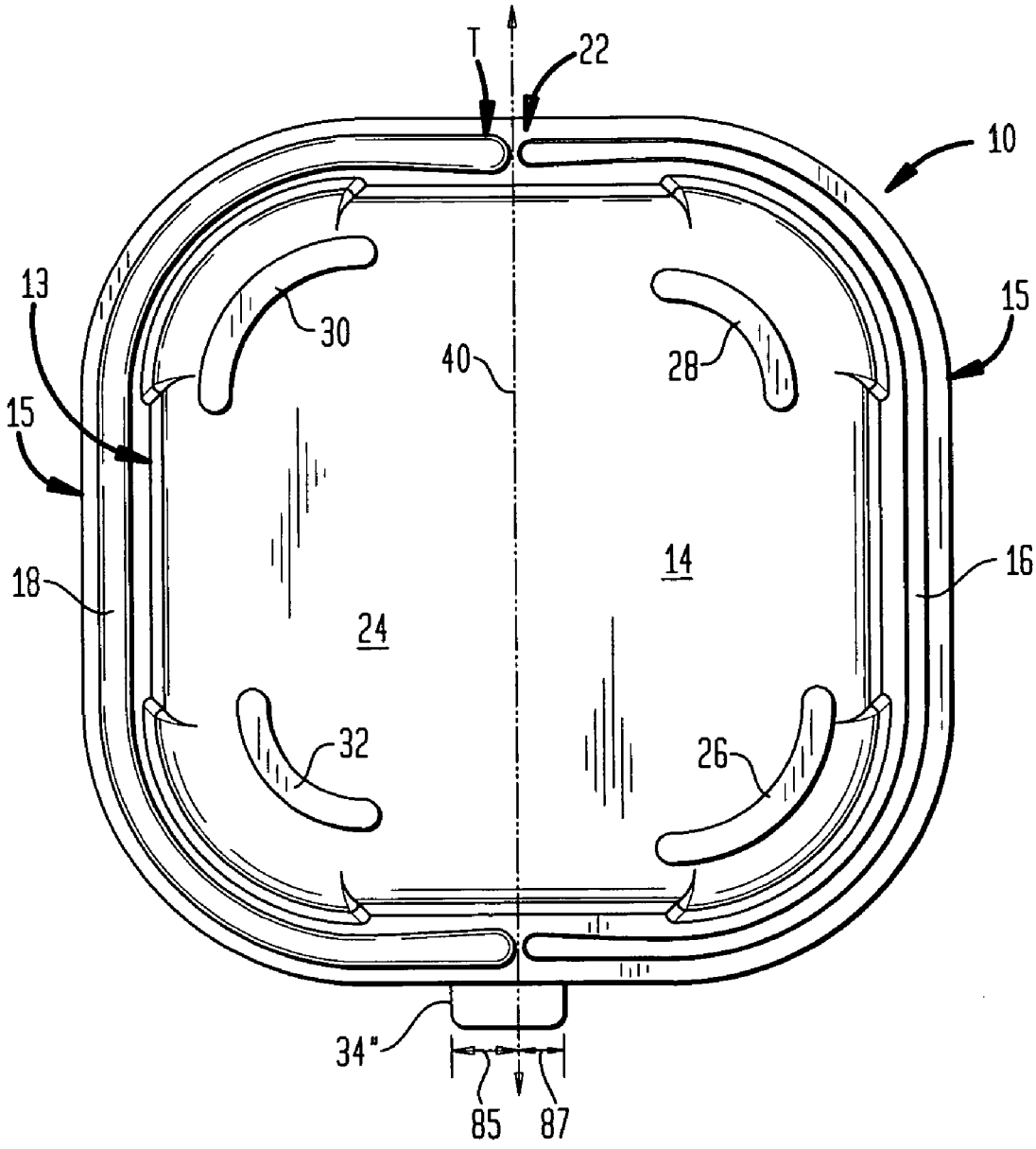
FIG. 8 is a top view of yet another container of the present invention.

For example, instead of the corner tabs with an inclined profile illustrated in FIGS. 1, 2, 5 and 6, it is possible to use corner tabs 34', 36' which project different distances d, d' from the ridges and grooves of the rim and extend over different circumferential distances L, L' as is seen in FIG. 7. It will be appreciated by one of skill in the art that any two tabs asymmetrically configured with respect to axis of rotation 40 will be readily distinguishable from one another when two containers are joined together because the tabs will not completely overlay each other. Likewise, one could employ a single tab 34" (FIG. 8) asymmetrically arranged about axis 40 to project different distances 85, 87 on either side of axis 40 to like effect.

What is claimed is:

1. A container having a dome portion with a substantially planar central portion and a sidewall extending from the central portion of the dome and transitioning to a rim wherein the rim has an interlockable rim structure defined about the periphery of the container in a rim plane, said interlockable rim structure having at least one radially undercut male ridge section and at least one radially undercut female groove section defined therein, as well as a pair of arculate undercut transition sections therebetween, wherein said ridge section and said groove section have generally identical U-shapes and said radially undercut male ridge and radially undercut female groove sections being configured such that the radially undercut male ridge and radially undercut female groove sections on a container having a substantially identical interlockable rim structure will seal with interpenetrating resilient engagement extending substantially entirely around the periphery of said container, the radial undercuts on said ridges and grooves being configured to urge the grooves and ridges on containers having a substantially identical interlockable rim structure into sealing radial engagement and wherein the arculate undercut transition sections are configured such that the arculate undercut transition sections on a container having a substantially identical rim structure will urge the transition sections into virtually sealing engagement when containers with like rim structures are joined to form a closed container.

2. The container according to claim 1, wherein said arculate undercut transition sections have a vertically extending female undercut wall, a vertically extending male undercut wall and a ledge therebetweeen.

3. A container having a dome portion with a substantially planar central portion and a sidewall extending from the central portion of the dome and transitioning to a rim wherein the rim has an interlockable rim structure defined about the periphery of the container in a rim plane, said interlockable rim structure having at least one radially undercut male ridge section and at least one radially undercut female groove section defined therein, as well as a pair of arculate undercut transition sections therebetween, said radially undercut male ridge and radially undercut female groove sections being configured such that the radially undercut male ridge and radially undercut female groove sections on a container having a substantially identical interlockable rim structure will seal with interpenetrating resilient engagement about the periphery of said container, the radial undercuts on said ridges and grooves being configured to urge the grooves and ridges on containers having a substantially identical interlockable rim structure into sealing radial engagement and wherein the arculate undercut transition sections are configured such that the arculate undercut transition sections on a container having a substantially identical rim structure will urge the transition sections into virtually sealing engagement when containers with like rim structures are joined to form a closed container wherein the dome is generally rectangular and is provided with reinforced rounded corners projecting radially outwardly from recessed sidewall portions therebetween and wherein further the central portion of the dome is provided with a plurality of asymmetrically disposed arcuate stacking ridges at the corners of the central portion of the dome, the stacking ridges having generally the same curvature as the sidewall at the corners, and being asymmetrically offset across an axis of rotation so as to cooperate with like ridges on an inverted like container to secure a plurality of containers in a stack thereof.

4. A container having a dome portion with a substantially planar central portion and a sidewall extending from the central portion of the dome and transitioning to a rim wherein the rim has an interlockable rim structure defined about the periphery of the container in a rim plane, said interlockable rim structure having at least one radially undercut male ridge section and at least one radially undercut female groove section defined therein, as well as a pair of arculate undercut transition sections therebetween, said radially undercut male ridge and radially undercut female groove sections being configured such that the radially undercut male ridge and radially undercut female groove sections on a container having a substantially identical interlockable rim structure will seal with interpenetrating resilient engagement about the periphery of said container, the radial undercuts on said ridges and grooves being configured to urge the grooves and ridges on containers having a substantially identical interlockable rim structure into sealing radial engagement and wherein the arculate undercut transition sections are configured such that the arculate undercut transition sections on a container having a substantially identical rim structure will urge the transition sections into virtually sealing engagement when containers with like rim structures are joined to form a closed container, wherein the central portion of the dome is provided with a plurality of asymmetrically disposed stacking ridges at the periphery of the central portion of the dome, the stacking ridges being asymmetrically disposed across an axis of rotation so as to cooperate with like ridges on an inverted like container to secure a plurality of containers in a stack thereof.

5. The container according to claim 1, wherein the rim structure defines at least one tab provided with a surface which is inclined with respect to the rim plane.

6. The container according to claim 5, wherein the inclined surface of the rim tab has an angle of inclination of from about 3 to about 40 degrees with respect to the rim plane.

7. The container according to claim 6, wherein the inclined surface of the rim tab has an angle of inclination of from about 10 to about 30 degrees with respect to the rim plane.

8. The container according to claim 1, wherein said rim structure includes at least two peripheral tabs asymmetrically configured with respect to an axis of rotation.

9. The container according to claim 8, wherein the two tabs project outwardly different distances from the ridges and grooves of the rim structure.

10. The container according to claim 8, wherein the two tabs extend over different circumferential distances about the rim structure.

11. The container according to claim 8, wherein the two peripheral tabs are corner tabs.

12. The container of claim 1, wherein the rim structure further includes a peripheral tab asymmetrically disposed about an axis of rotation of said interlocking rim structure such that said peripheral tab will be offset with respect to a substantially identical tab on a substantially identical interlocking rim structure when engaged thereto.

13. The container of claim 1, wherein said U-shaped undercut male ridge section and said U-shaped undercut female groove section are undercut on both sidewalls thereof.

14. The container of claim 13, wherein said undercut male ridge section and said undercut female groove section each include a substantially planar medial portion.

15. The container of claim 14, wherein said undercut male ridge section and said undercut female groove section are configured such that their respective substantially planar medial sections are urged into engagement with each other.

16. The container of claim 15, wherein said undercut male ridge section and said undercut female groove section are configured such that their respective substantially planar medial sections are urged into surface to surface engagement with each other between the sidewalls of the groove and ridge sections by cooperation of the sidewalls.

17. The container according to claim 1, fabricated from a thermoplastic material by way of a technique selected from the group consisting of injection molding, injection blowmolding, compression molding, injection stretch blowmolding and composite injection molding.

18. The container of claim 1, formed from a sheet of thermoplastic material.

19. The container according to claim 18, wherein said container is thermoformed, thermoformed by the application of vacuum or thermoformed by a combination of vacuum and pressure.

20. The container according to claim 18, thermoformed by the application of vacuum and pressure.

21. The container according to claim 18, wherein said thermoplastic material is selected from the group consisting of: polyamides; polyacrylates; polysulfones; polyetherketones; polycarbonates; acrylics; polyphenylene sulfides; liquid crystal polymers; acetal; cellulosic polymers; polyetherimides; polyphenylene ethers or oxides; styrene-maleic anhydride copolymers; styrene-acrylonitrile copolymers; polyvinyl chlorides and mixtures thereof.

22. The container of claim 18, wherein said thermoplastic material comprises a polymeric material selected from the group consisting of: polyesters; polystyrenes; polypropylenes; polyethylenes and mixtures thereof.

23. The container of claim 22, wherein said container has a wall thickness of from about 5 to about 50 mils.

24. The container according to claim 23, wherein said container has a wall thickness of from about 15 mils to about 25 mils.

25. The container according to claim 18, having a wall thickness of from about 5 to about 80 mils and formed from a foamed polymeric material.

26. The container according to claim 22, wherein said polymeric material comprises polystyrene.

27. The container according to claim 22, wherein said thermoplastic material comprises polyethylene.

28. The container according to claim 22 wherein said polymeric material comprises polypropylene.

29. The container of claim 28, wherein said polypropylene is mineral-filled.

30. The container according to claim 29, wherein said mineral-filler comprises mica and wherein said polymeric material comprises from about 40 to about 90% by weight polypropylene and from about 10 to about 50% by weight mica.

31. The container according to claim 30, further comprising calcium carbonate.

32. The container according to claim 22, wherein said thermoplastic material comprises a mineral filler.

33. The container according to claim 17, injection-molded from a thermoplastic material comprising a polymeric material selected from the group consisting of: polyesters, polystyrenes, polypropylenes, polyethylenes and mixtures thereof.

34. The container according to claim 33, wherein said thermoplastic material comprises polypropylene.

35. The container according to claim 33, wherein said thermoplastic material comprises polyethylene.

36. The container according to claim 33, wherein said thermoplastic material comprises polystyrene.

37. A container integrally formed of a thermoplastic material having a dome with a central portion and sidewall which transitions to an interlockable rim structure about a rim plane defined about the periphery thereof, said interlockable rim structure comprising:

(a) a male ridge section projecting upwardly from said rim plane extending circumferentially over at least a portion of the periphery of said container;

(b) a female groove section projecting downwardly from said rim plane extending circumferentially over at least a portion of the periphery of said container; and (c) a pair of transition sections extending between the male ridge section and the female groove section;

said interlockable rim structure being configured to seal with a substantially identical rim structure rotated 180° about an axis of rotation such that when the male ridge sections are disposed in sealing engagement with corresponding female groove sections the ridges and grooves are urged into surface-to-surface engagement and the transition sections are urged into virtually sealing engagement with the corresponding transition sections of the substantially identical rim structure, and wherein the ridge section and groove section have generally identical U-shapes and the transition sections are provided with arculate undercut walls.

38. The container according to claim 37, wherein said transition sections have a generally vertical female undercut wall, a generally vertical male undercut wall and a ledge therebetweeen.

39. A container integrally formed of a thermoplastic material having a dome with a central portion and sidewall which transitions to an interlockable rim structure about a rim plane defined about the periphery thereof, said interlockable rim structure comprising:

(a) a male ridge section projecting upwardly from said rim plane extending circumferentially over at least a portion of the periphery of said container;

(b) a female groove section projecting downwardly from said rim plane extending circumferentially over at least a portion of the periphery of said container; and (c) a pair of transition sections extending between the male ridge section and the female groove section:

said interlockable rim structure being configured to seal with a substantially identical rim structure rotated 180° about an axis of rotation such that when the male ridge sections are disposed in sealing engagement with corresponding female groove sections the ridges and grooves are urged into surface-to-surface engagement and the transition sections are urged into virtually sealing engagement with the corresponding transition sections of the substantially identical rim structure, wherein the dome is generally rectangular and is provided with reinforced rounded corners projecting radially outwardly from recessed sidewall portions therebetween, and wherein the central portion of the dome is provided with a plurality of asymmetrically disposed arcuate stacking ridges at the corners of the central portion of the dome, the stacking ridges at the corners of the central portion of the dome having generally the same curvature as the sidewall at its corners, and being asymmetrically offset across an axis of rotation so as to cooperate with complementary ridges on an inverted like container to secure a plurality of containers in a stack thereof.

40. A container integrally formed of a thermoplastic material having a dome with a central portion and sidewall which transitions to an interlockable rim structure about a rim plane defined about the periphery thereof, said interlockable rim structure comprising:

(a) a male ridge section projecting upwardly from said rim plane extending circumferentially over at least a portion of the periphery of said container;

(b) a female groove section projecting downwardly from said rim plane extending circumferentially over at least a portion of the periphery of said container; and (c) a pair of transition sections extending between the male ridge section and the female groove section;

said interlockable rim structure being configured to seal with a substantially identical rim structure rotated 180° about an axis of rotation such that when the male ridge sections are disposed in sealing engagement with corresponding female groove sections the ridges and grooves are urged into surface-to-surface engagement and the transition sections are urged into virtually sealing engagement with the corresponding transition sections of the substantially identical rim structure, wherein the central portion of the dome is provided with a plurality of asymmetrically disposed stacking ridges at the periphery of the central portion of the dome, the stacking ridges being asymmetrically disposed across an axis of rotation so as to cooperate with complementary ridges on an inverted like container to secure a plurality of containers in a stack thereof.

41. The container according to claim 37, wherein the rim structure defines at least one tab provided with a surface which is inclined with respect to the rim plane.

42. The container according to claim 41, wherein the inclined surface of the rim tab has an angle of inclination of from about 3 to about 40 degrees with respect to the rim plane.

43. The container according to claim 42, wherein the inclined surface of the rim tab has an angle of inclination of from about 10 to about 20 degrees with respect to the rim plane.

44. The container according to claim 41, wherein the rim structure defines at least two tabs provided with surfaces which are inclined with respect to the rim plane and wherein further the tabs project outwardly different distances from the periphery of the container.

45. The container according to claim 37, wherein said rim structure includes at least two peripheral tabs asymmetrically configured with respect to an axis of rotation.

46. The container according to claim 45, wherein the two tabs project outwardly different distances from the ridges and grooves of the rim structure.

47. The container according to claim 45, wherein the two tabs extend over different circumferential distances about the rim structure.

48. The container according to claim 45, wherein the two peripheral tabs are corner tabs.

49. The container of claim 37, wherein the rim structure further includes a peripheral tab asymmetrically disposed about an axis of rotation of said interlocking rim structure such that said peripheral tab will be offset with respect to a substantially identical tab on a substantially identical interlocking rim structure when engaged thereto.

50. A thermoformed container having a dome portion with a substantially planar central portion and a sidewall extending from the central portion of the dome and transitioning to a rim wherein the rim has an interlockable rim structure defined about the periphery of the container in a rim plane, said interlockable rim structure having at least one radially undercut male ridge section and at least one radially undercut female groove section defined therein, as well as a pair of transition sections therebetween, the radially undercut male ridge and radially undercut female groove sections being drawn generally at a sealing rim draw ratio and being configured such that the radially undercut male ridge and radially undercut female groove sections on a container having a substantially identical interlockable rim structure will seal with interpenetrating resilient engagement therewith extending substantially entirely around the periphery of said container, the radial undercuts on said ridges and grooves being configured to urge the grooves and ridges on containers having a substantially identical interlockable rim structure into sealing radial engagement and wherein the transition sections are drawn at a transition draw ratio that is less than the sealing rim draw ratio.

51. The thermoformed container according to claim 50, wherein the transition draw ratio is less than about 90% of the sealing rim draw ratio.

52. The thermoformed container according to claim 51, wherein the transition draw ratio is less than about 80% of the sealing rim draw ratio.

53. The thermoformed container according to claim 52, wherein the transition draw ratio is less than about 70% of the sealing rim draw ratio.

54. The thermoformed container according to claim 50, wherein the transition sections have an arculate undercut profiles.

* * * * *